US005579854A

United States Patent [19]

Barry

[11] Patent Number: 5,579,854

[45] Date of Patent: Dec. 3, 1996

[54] DRILL PIPE CASING PROTECTOR AND METHOD

[75] Inventor: William H. Barry, Stafford, Tex.

[73] Assignee: Fernando J. Guzman, Houston, Tex.

[21] Appl. No.: 461,060

[22] Filed: Jun. 5, 1995

[51] Int. Cl.[6] ..... E21B 17/10

[52] U.S. Cl. ..... 175/57; 166/241.7; 175/325.3; 175/325.6

[58] Field of Search ..... 166/241.7, 241.6, 166/241.1, 241.3, 241.2, 241.4; 175/325.6, 325.3, 57

[56] References Cited

U.S. PATENT DOCUMENTS

| | | | |
|---|---|---|---|
| 1,651,088 | 11/1927 | Fentress | 175/325.3 |
| 2,127,796 | 8/1938 | Willis | 166/241.3 |
| 2,860,013 | 11/1958 | Medearis | 175/325.6 |
| 3,197,262 | 7/1965 | Fairchild | 175/325.6 |
| 3,894,780 | 7/1975 | Broussard | 175/325.6 |
| 5,069,297 | 12/1991 | Krueger et al. | 175/325.6 X |
| 5,191,938 | 3/1993 | Sable et al. | 166/241.3 X |
| 5,261,498 | 11/1993 | Steinkamp et al. | 175/325.3 |

*Primary Examiner*—Hoang C. Dang
*Attorney, Agent, or Firm*—Kenneth A. Roddy

[57] ABSTRACT

A drill pipe casing protector has an inner hub member releasably secured to the exterior of a drill pipe to rotate therewith and an outer buffer ring rotatably mounted on the inner hub to allow relative rotation between the drill pipe and the outer buffer ring when the outer buffer ring engages the interior of the casing in which the drill pipe is rotating to prevent abrasive wear between the drill string and the interior of the casing. The inner hub is formed of semi-cylindrical elastomer segments which are clamped around the drill pipe, each having a metallic semi-cylindrical cage element embedded therein and a semi-cylindrical low friction bearing surface on the exterior thereof. A tapered wedge pin draws the elastomer segments radially inward to firmly grip the drill pipe and secure the inner hub member thereto. The outer buffer ring is also formed of semi-cylindrical elastomer segments each having a metallic semi-cylindrical cage element embedded therein which encircle the inner hub bearing surface in radially spaced relation to allow relative rotation therebetween. The outer buffer ring prevents contact between the exterior of the drill pipe and the interior of the casing, and the drill string and inner hub rotate together relative to the outer buffer ring when it is frictionally engaged with the interior of the casing. Drilling fluid provides lubrication between the inner hub member and outer buffer ring.

15 Claims, 2 Drawing Sheets

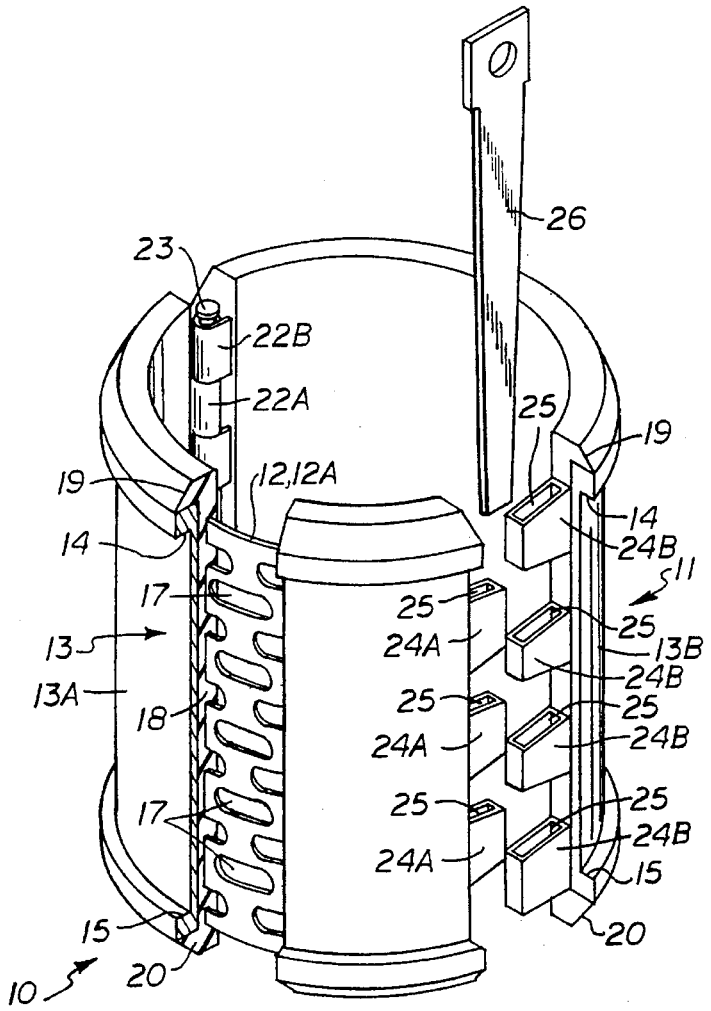
FIG. 1
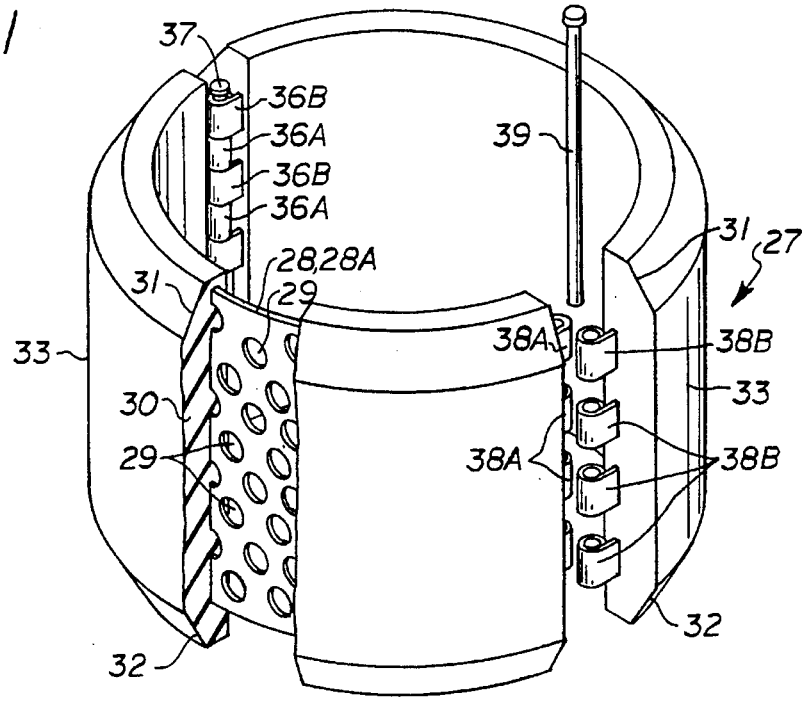

DRILL PIPE CASING PROTECTOR AND METHOD

BACKGROUND OF THE INVENTION

1. Field of the Invention

This invention relates generally to drill pipe protectors, and more particularly to a drill pipe protector having an inner hub attached to the drill pipe exterior and an outer buffer ring encircling the inner hub in radially spaced relation which allows relative rotation between the drill pipe and the outer buffer ring when the outer buffer ring engages the interior of the casing in which the drill pipe is rotating.

2. Brief Description of the Prior Art

Elastomer drill pipe protectors installed on drill pipe to prevent casing wear by the tool joint connections are commonly used in rotary drilling operations. Conventional drill pipe protectors are in the form of a hinged, two-piece semi-cylindrical collar or sleeve made of rubber or other elastomeric material which is secured to an inner steel skeleton, also known as a cage. In transverse cross section, the hinged semi-cylindrical segments of the drill pipe protector form an open "C"-shaped configuration which allows the protector to be clamped around the drill pipe. The drill pipe protector is usually installed on the drill pipe near a tool joint connection. Closure and clamping of the segments onto the drill pipe is commonly achieved by driving a tapered latch pin through interlocking loops on the adjacent ends of the open C-shape which acts as a wedge to provide a tight grip on the drill pipe.

The outer diameter of the drill pipe protector is larger than the diameter of the tool joints of the drill pipe to prevent the tool joints from abrading the interior of the casing wall. When installed, the drill pipe protectors firmly grip the drill pipe and can resist several thousand pounds of side load or axial force without slipping on the drill pipe.

However, most prior art drill pipe protectors are subjected to high torque loads when their outer surface engages the interior of the casing in which the drill pipe is rotating, because there is no relative rotation between the drill pipe and the drill pipe protector. This often results in high torque loads in the drill string, prevention of rotation of the drill string, binding, or separation of the elastomeric material from the interior steel skeleton or cage.

These problems are aggravated by high side loading and torque loads encountered in deviated and horizontal drilling operations and conventional drill pipe casing protectors of unitary construction which are clamped tightly on the drill pipe are unsuitable for use in deviated and horizontal drilling operations.

There are several patents which disclose various drill pipe protectors.

Williams, U.S. Pat. No. 3,741,252 discloses a C-shaped drill pipe protector having a split sleeve sheath formed of thermoplastic material bonded to a metallic core which is clamped to the drill pipe by a tapered latch pin received through interlocking loops on the adjacent ends of the open C-shape. shape. A rubber sleeve insert is bonded to the interior diameter of the protector and is sandwiched between the exterior of the drill pipe and the interior diameter of the protector to prevent corrosion. There is no inner hub or relative rotation between the drill pipe and protector.

Hoon et al, U.S. Pat. No. 3,894,779 discloses a C-shaped drill pipe protector having a split sleeve sheath formed of elastomeric material bonded to a stretchable perforated metal core which is clamped to the drill pipe by a tapered latch pin received through interlocking loops on the adjacent ends of the open C-shape. The elastomeric material fills the perforations of the stretchable metal core and overlie the inner surface of the metal core. There is no inner hub or relative rotation between the drill pipe and protector.

Broussard, U.S. Pat. No. 3,894,780 discloses a hinged drill pipe protector having a pair of C-shaped segments formed of elastomeric material bonded to a metal core and joined by a hinge along one side. The opposed side has a pair of outwardly diverging tabs along opposed sides which are drawn together by a tapered latch which slides downwardly the tabs to secure the protector onto the pipe. The exterior of the protector has a series of vertical slots to allow drilling fluid to flow past the protector during drilling operations. There is no inner hub or relative rotation between the drill pipe and protector.

Sutko et al, U.S. Pat. No. 3,929,388 discloses a segmented pipe protector having a split inner steel cylinder which fits around the drill pipe and a concentric split outer steel cylinder which are secured together by a corrugated metal band disposed therebetween. The longitudinal ends of the C-shaped outer cylindrical segments have interfitting hooks along opposed sides which receive tapered pins to clamp the protector onto the drill pipe. There is no inner hub or relative rotation between the drill pipe and protector.

Fox et al, U.S. Pat. No. 4,042,023 discloses a C-shaped segmented control line protector formed of elastomeric material bonded to a metal cage. The longitudinal ends of the C-shaped members have interfitting projections which receive tapered pins to clamp the protector onto the drill pipe. The exterior of the control line protector has radially extending vertical ribs which are slotted to receive one or more control lines. There is no inner hub or relative rotation between the drill pipe and protector.

Swain et al, U.S. Pat. No. 4,266,578 discloses a hinged drill pipe protector having a pair of C-shaped segments formed of elastomeric material bonded to a metal core and joined by a hinge along one side. A thin layer of rubber is bonded to the interior of the metal core. The longitudinal sides of the segments opposite the hinge have interfitting projections which receive a tapered pin to clamp the protector onto the drill pipe. There is no inner hub or relative rotation between the drill pipe and protector.

Derouin, U.S. Pat. No. 4,384,626 discloses a clamp-on drill pipe stabilizer having a metal gripping sleeve with slotted and tapered ends forming fingers, a metal stabilizer body which carries the metal sleeve, a tapered lower end to engage the tapered lower end of the sleeve and a threaded upper end, and a lock nut threadedly engaged in the upper end of the stabilizer which engages a taper ring. The locknut forces the gripping sleeve downward to compress the fingers of the gripping sleeve inwardly to engage the exterior of the drill pipe. There is no inner hub and no elastomeric outer member, and there is no relative rotation between the drill pipe and protector when the lock nut is tightened.

Odell, U.S. Pat. No. 4,398,772 discloses a C-shaped drill pipe protector having a split sleeve sheath formed of elastomeric material bonded to a metallic core and interfitting projections along one side which receive a tapered pin to clamp the protector onto the pipe. The interior of the protector has a bead at the top and bottom ends to form a hydraulic seal between the exterior of the drill pipe and the protector. There is no inner hub or relative rotation between the drill pipe and protector.

Krueger et al, U.S. Pat. No. 5,069,297 discloses a pipe protector having a C-shaped sleeve sheath formed of elastomeric material bonded to a metallic core and interfitting projections along one side which receive a latch pin to secure the protector onto the pipe. An upper and lower split ring bearing are clamped around the drill pipe at the top and bottom of the protector. The interior of the protector has a series of longitudinal grooves defining longitudinal wedges which are angled between the vertical grooves to reduce frictional drag on the drill pipe. The elastomeric sleeve rotates with the drill pipe, but when the exterior of the sleeve engages the wall of the casing, the sleeve stops rotating, or slightly rotates, and allows the drill pipe to continue rotating inside the sleeve due to the configuration of the grooved interior aided by the drilling fluid. Although there is some relative rotation between the drill pipe and the elastomeric protector due to the reduced frictional engagement of longitudinal grooves and wedges on the interior of the protector, there is no inner hub or relative rotation between the drill pipe and an inner hub.

The present invention is distinguished over the prior art in general, and these patents in particular by a drill pipe casing protector having an inner hub member releasably secured to the exterior of a drill pipe to rotate therewith and an outer buffer ring rotatably mounted on the inner hub to allow relative rotation between the drill pipe and the outer buffer ring when the outer buffer ring engages the interior of the casing in which the drill pipe is rotating to prevent abrasive wear between the drill string and the interior of the casing. The inner hub is formed of semi-cylindrical elastomer segments which are clamped around the drill pipe, each having a metallic semi-cylindrical cage element embedded therein and a semi-cylindrical low friction bearing surface on the exterior thereof. A tapered wedge pin draws the elastomer segments radially inward to firmly grip the drill pipe and secure the inner hub member thereto. The outer buffer ring is also formed of semi-cylindrical elastomer segments each having a metallic semi-cylindrical cage element embedded therein which encircle the inner hub bearing surface in radially spaced relation to allow relative rotation therebetween. The outer buffer ring prevents contact between the exterior of the drill pipe and the interior of the casing, and the drill string and inner hub rotate together relative to the outer buffer ring when it is frictionally engaged with the interior of the casing. Drilling fluid provides lubrication between the inner hub member and outer buffer ring.

SUMMARY OF THE INVENTION

It is therefore an object of the present invention to provide a drill pipe casing protector which will prevent contact between the exterior of a drill pipe and the interior of the casing within which the drill string is rotated.

It is another object of this invention is to provide a drill pipe casing protector which will withstand high side loading, axial loading or drag, and significantly reduce torque forces on a drill string.

Another object of this invention is to provide a drill pipe casing protector which will allow free rotation of a drill string when the exterior of the protector is frictionally engaged on the interior of the casing within which the drill string is rotated.

Another object of this invention is to provide a drill pipe casing protector which will allow passage of drilling fluid therethrough and utilize a portion of the drilling fluid as a lubricant to facilitate rotation of a drill string when the exterior of the protector is frictionally engaged on the interior of the casing within which the drill string is rotated.

Another object of this invention is to provide a drill pipe casing protector which can be easily and quickly installed on a drill pipe on the rig floor.

A further object of this invention is to provide a drill pipe casing protector which is simple in construction, economical to manufacture, and rugged and durable in use.

A still further object of this invention is to provide a method for preventing abrasive wear between the exterior of a drill pipe and the interior of the casing within which the drill string is rotated.

Other objects of the invention will become apparent from time to time throughout the specification and claims as hereinafter related.

The above noted objects and other objects of the invention are accomplished by a drill pipe casing protector having an inner hub member releasably secured to the exterior of a drill pipe to rotate therewith and an outer buffer ring rotatably mounted on the inner hub to allow relative rotation between the drill pipe and the outer buffer ring when the outer buffer ring engages the interior of the casing in which the drill pipe is rotating to prevent abrasive wear between the drill string and the interior of the casing. The inner hub is formed of semi-cylindrical elastomer segments which are clamped around the drill pipe, each having a metallic semi-cylindrical cage element embedded therein and a semi-cylindrical low friction bearing surface on the exterior thereof. A tapered wedge pin draws the elastomer segments radially inward to firmly grip the drill pipe and secure the inner hub member thereto. The outer buffer ring is also formed of semi-cylindrical elastomer segments each having a metallic semi-cylindrical cage element embedded therein which encircle the inner hub bearing surface in radially spaced relation to allow relative rotation therebetween. The outer buffer ring prevents contact between the exterior of the drill pipe and the interior of the casing, and the drill string and inner hub rotate together relative to the outer buffer ring when it is frictionally engaged with the interior of the casing. Drilling fluid provides lubrication between the inner hub member and outer buffer ring.

BRIEF DESCRIPTION OF THE DRAWINGS

FIG. 1 is an exploded isometric view of the inner hub member and outer buffer ring member of the drill pipe casing protector in accordance with the present invention, shown in an unassembled condition with portions of their side walls cut away to show, the interior cage elements

DESCRIPTION OF THE PREFERRED EMBODIMENT

Figure 2:
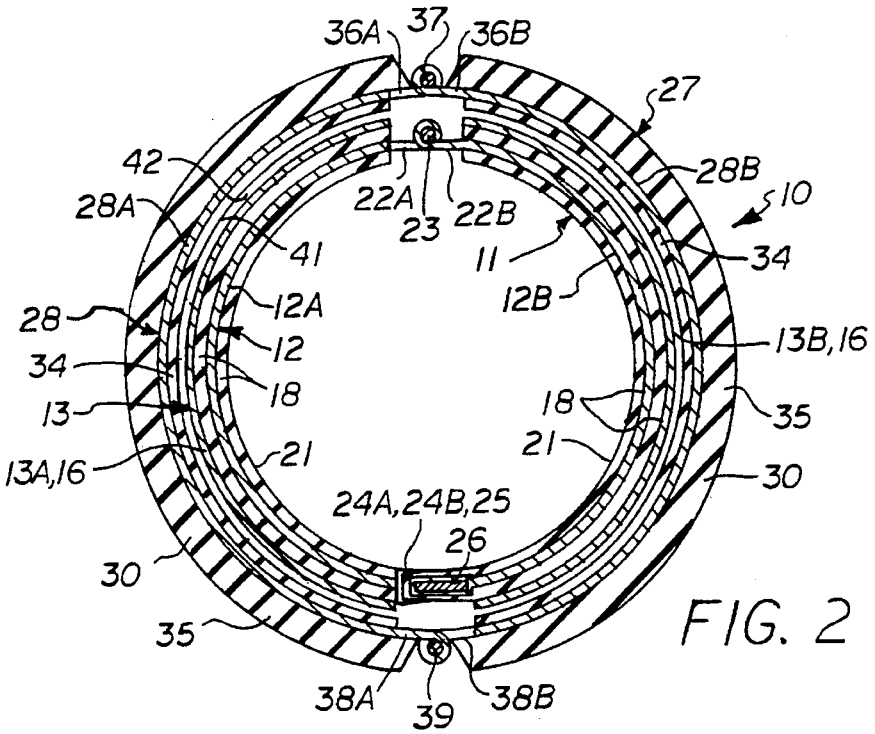
FIG. 2 is a transverse cross section view of the inner hub member and outer buffer ring member of the drill pipe casing protector shown in an assembled condition.

Referring to the drawings by numerals of reference, there is shown in FIG. 1, a preferred drill pipe casing protector 10 shown in an unassembled condition. The drill pipe protector 10 has an inner hub member 11 which is adapted to be releasably secured to the exterior of a drill pipe near a tubing joint connection and an outer buffer ring member 27 which is adapted to be secured around the inner hub member 11 in radially spaced relation to allow relative rotation therebetween.

Figure 3:
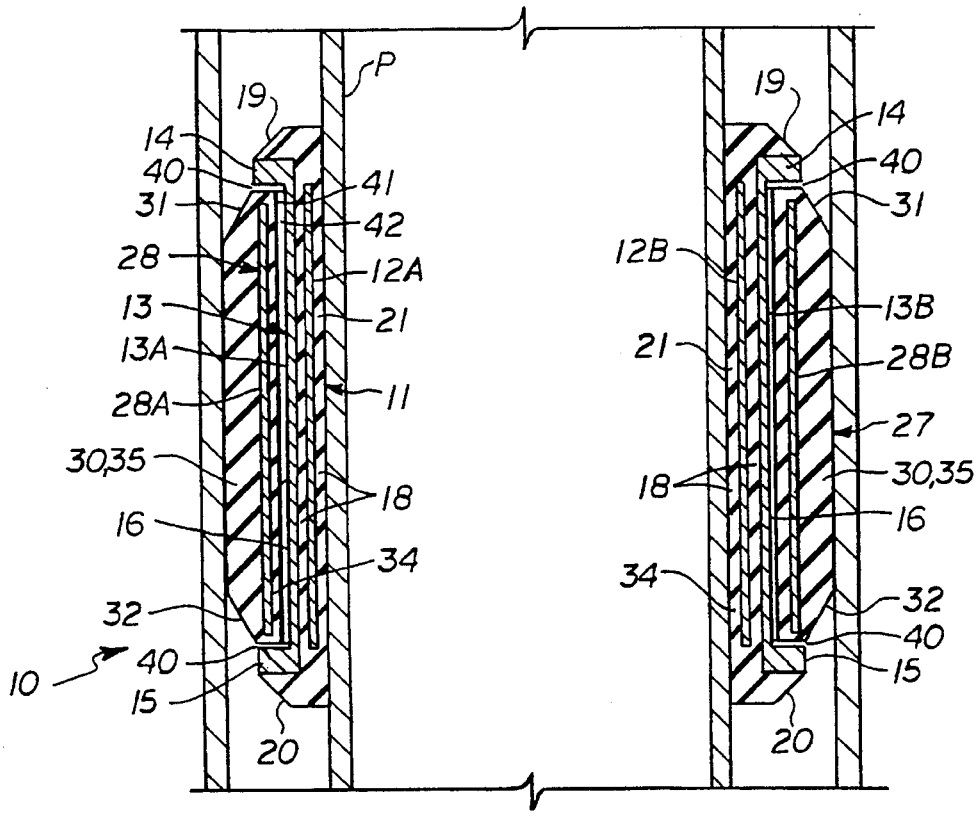
FIG. 3 is a longitudinal cross section view of the assembled inner hub member and outer buffer ring member shown with the inner hub member secured to a drill pipe and the outer buffer ring engaged on the interior of a casing.

Referring additionally to FIGS. 2 and 3, the inner hub 11 has a steel skeleton or cage 12 formed of two halves or segments 12A and 12B, each semi-cylindrical in shape. The inner hub 11 also has a steel outer spool 13 formed of two semi-cylindrical halves or segments 13A and 13B which are radially spaced outwardly from the cage segments 12A and 12B. The top and bottom ends of the steel spool segments 13A and 13B extend radially outward to define vertically opposed radial shoulders 14 and 15 with a reduced diameter portion 16 therebetween which serves as a bearing surface.

Although a segmented steel spool has been shown and described as an example of a preferred embodiment, it should be understood that other suitable materials other than steel may be used to provide a low friction bearing surface on the exterior of the inner hub 11.

As shown in cutaway in FIG. 1, the cage segments 12A and 12B have a plurality of alternately spaced slots 17 through their side walls in parallel vertically spaced and circumferentially offset relation. Elastomeric material 18 is bonded, in a molding operation, to each cage segment 12A and 12B to surround the metal surface of the cage segments, extend through the slots 17, and fill the space between the interior surface of the outer spool segments 13A and 13B, such that the cage segments 12A and 12B are securely embedded in the elastomeric material and the outer spool segments are bonded to the elastomeric material. The top and bottom ends 19 and 20 of the elastomeric body extend radially outward to overlap the top and bottom ends of the vertically opposed radial shoulders 14 and 15 of the outer spool segments 13A and 13B. The elastomeric material 18 forms a relatively thin elastomeric layer or lining 21 on the interior of the cage segments 12A and 12B.

The adjacent longitudinal edges of the cage segments 12A and 12B have mating circumferential hinge protrusions 22A and 22B along one side which extend outwardly from the elastomeric material and receive a hinge pin 23 to interconnect the cage segments together and form a hinged connection along one vertical side of the inner hub 11.

The adjacent longitudinal edges of the cage segments 12A and 12B diametrically opposite the hinge connection have mating circumferential tapered protrusions 24A and 24B along one side which may be covered with the elastomeric material. The protrusions 24A and 24B have rectangular holes or loops 25 formed vertically therethrough which are of diminishing width from the top to bottom protrusion to define a tapered opening through the protrusions when overlapped. A tapered wedge drive pin 26 is received through the loops 25 of the overlapped projections 24A and 24B and, when driven downwardly, acts as a wedge to draw the protrusions together and draw the inner hub segments 12A and 12B radially inward and form a unitary cylinder which is tightly clamped to the exterior of the drill pipe. The tapered drive pin and loop arrangement also allows the interior of the inner hub segments to tightly engage exteriors of drill pipe having varying diameters caused by manufacturing tolerances.

The outer buffer ring member 27 has a steel skeleton or cage 28 formed of two halves or segments 28A and 28B, each semi-cylindrical in shape. As shown in cutaway in FIG. 1, the buffer ring cage segments 28A and 28B have a plurality of alternately spaced holes 29 through their side walls in parallel vertically spaced and circumferentially offset relation. Elastomeric material 30 is bonded, in a molding operation, to each cage segment 28A and 28B to surround the metal surface of the cage segments and extend through the holes 29 such that the cage segments are securely embedded in the elastomeric material. The top and bottom ends 31 and 32 of the elastomeric body taper outwardly to the outer diameter 33. The elastomeric material 30 forms a relatively thin elastomeric layer or lining 34 on the interior of the cage segments 28A and 28B and a thicker layer 35 on the exterior. The outer diameter 33 of the buffer ring 27 is larger than the diameter of the tool joints of the drill pipe.

The adjacent longitudinal edges of the cage segments 28A and 28B have mating circumferential hinge protrusions 36A and 36B along one side which extend outwardly from the elastomeric material and receive a hinge pin 37 to interconnect the cage segments together and form a hinged connection along one vertical side of the outer buffer ring 27. The adjacent longitudinal edges of the cage segments 28A and 28B diametrically opposite the hinge connection have mating circumferential protrusions 38A and 38B along one side which extend outwardly from the elastomeric material, similar to the hinge protrusions, and receive a rod or retainer pin 39 to interconnect the buffer ring cage segments together and form a unitary cylinder having a fixed interior diameter and a fixed outer diameter which is larger than the diameter of the tool joints of the drill pipe, but smaller than the interior diameter of the casing in which the drill string moves.

As best seen in FIGS. 2 and 3, the inner hub 11 is tightly clamped to the exterior of the drill pipe P near a tool joint by driving the tapered wedge drive pin 26 through the loops 25 of the overlapped projections 24A and 24B which draws the projection together and the inner hub segments 12A and 12B radially inward to grip the drill pipe. The inner hub member 11 rotates with the drill pipe. The buffer ring member 27 is installed around the reduced diameter portion 16 of the outer spool segments 13A and 13B of the inner hub 11 between the opposed radial shoulders 14 and 15 by installing the retainer pin 39 into the protrusions 38A and 38B which interconnects the buffer ring cage segments together and forms a unitary cylinder having a fixed interior diameter radially spaced from the reduced diameter 16 of the spool 13.

The height of the buffer ring 27 is slightly shorter than the vertical distance between the opposed radial shoulders 14 and 15 to form a small gap or radial passageway 40 between the top and bottom surfaces of the buffer ring and the opposed surfaces of the radial shoulders. The radial shoulders 14 and 15 extend radially outward beyond the diameter of the cage segments 28A and 28B embedded in the buffer ring 27, and prevent any appreciable axial movement of the buffer ring relative to the inner hub 11.

The interior diameter 41 of the buffer ring 27 is slightly greater than the reduced diameter 16 of the outer spool segments 13A and 13B and radially spaced therefrom to define an annulus 42 therebetween which allows free relative rotation between the inner hub 11 and the outer buffer ring.

During normal drilling operations, drilling fluid is pumped under pressure through the drilling string and floods the borehole. The annulus 42 between the reduced diameter 16 of the spool 13 and the interior diameter 41 of the buffer ring 27 and the radial passageways 40 between the top and bottom surfaces of the buffer ring and the opposed surfaces of the radial shoulders 14 and 15 provide a fluid flow path for the drilling fluid, such that the drilling fluid acts as a lubricant between the spool of the inner hub and the interior of the buffer ring.

Although the outer diameter 33 and interior diameter 41 of the buffer ring 27 are shown as smooth surfaces, it should be understood that the outer and/or interior diameters may be provided with vertical or spiral grooves to facilitate passage and distribution of drilling fluid, depending upon the size of the drill string and casing specifications.

While this invention has been described fully and completely with special emphasis upon a preferred embodiment, it should be understood that within the scope of the appended claims the invention may be practiced otherwise than as specifically described herein.

I claim:

1. A drill pipe casing protector for preventing abrasive wear between the exterior of a rotating drill string and the interior of a casing within which the drill string is rotated, comprising:

an inner hub member formed of semi-cylindrical elastomer segments adapted to be received on and substantially encircle a drill pipe, each having a metallic semi-cylindrical cage element embedded therein and a semi-cylindrical low friction bearing surface on the exterior thereof;

clamping means on said inner hub member for drawing said semi-cylindrical elastomer segments radially inward to secure said inner hub member to said drill pipe to rotate therewith;

an outer buffer ring member formed of semi-cylindrical elastomer segments each having a metallic semi-cylindrical cage element embedded therein, said outer buffer ring rotatably mounted on and encircling said inner hub member semi-cylindrical low friction bearing surface to allow relative rotation therebetween, and said outer buffer ring member having an exterior surface extending radially outward from said drill pipe to prevent contact between the exterior of said drill pipe and the interior of the casing within which the drill string is rotated; and said drill string and said inner hub member rotating together relative to said outer buffer ring member when it is frictionally engaged with the interior of said casing.

2. The drill pipe casing protector according to claim 1 in which said outer buffer ring member has an interior surface encircling said inner hub member low friction bearing surface in radially spaced relation to define an annulus therebetween for passage of drilling fluid therethrough to lubricate said bearing surface and said encircling interior surface of said buffer ring.

3. The drill pipe casing protector according to claim 1 in which said inner hub member low friction bearing surface is formed of semi-cylindrical metallic segments secured to the exterior of said semi-cylindrical elastomer segments.

4. The drill pipe casing protector according to claim 1 in which said inner hub cage elements have a plurality of apertures through their side walls and elastomeric material extending through said apertures and surrounding said inner hub cage elements and forming a thin smooth layer of elastomeric material on the inner surfaces thereof for gripping the exterior of said drill pipe.

5. The drill pipe casing protector according to claim 1 in which said inner hub member cage elements are hingedly connected along adjacent longitudinal edges and have a wedge receiving clamping structure along their diametrically opposed longitudinal edges, and a tapered wedge drive pin releasably received in said clamping structure to draw said inner hub member semi-cylindrical segments radially inward to firmly grip the exterior of said drill pipe.

6. The drill pipe casing protector according to claim 5 in which said clamping structure comprises a plurality of mating circumferential protrusions along adjacent said diametrically opposed longitudinal edges of said inner hub member cage segments interfitting in vertically overlapped relation; and apertures extending vertically through said protrusions configured to draw said protrusions together and said inner hub member semi-cylindrical segments radially inward when said tapered wedge drive pin is pressed vertically into said apertures.

7. The drill pipe casing protector according to claim 1 in which said outer buffer ring cage elements have a plurality of apertures through their side walls and elastomeric material extending through said apertures and surrounding said outer buffer ring cage elements and forming a thin smooth layer of elastomeric material on the inner surfaces thereof.

8. The drill pipe casing protector according to claim 1 in which said outer buffer ring member cage elements are hingedly connected along adjacent longitudinal edges and have a retaining pin receiving structure along their diametrically opposed longitudinal edges, and a retaining pin releasably received in said retaining pin receiving structure to interconnect said outer buffer ring member semi-cylindrical segments together and form a unitary cylindrical body having a predetermined fixed interior diameter and a predetermined fixed outer diameter.

9. The drill pipe casing protector according to claim 8 in which said outer buffer ring member predetermined fixed interior diameter encircles said inner hub member low friction bearing surface in radially spaced relation to define an annulus therebetween for passage of drilling fluid therethrough to lubricate said bearing surface and said encircling interior surface of said buffer ring.

10. The drill pipe casing protector according to claim 9 in which said inner hub member low friction bearing surface has a radially extending shoulder at opposite ends thereof to retain said buffer ring member thereon in the encircled condition and limit axial movement therebetween.

11. The drill pipe casing protector according to claim 9 in which said inner hub member low friction bearing surface is formed of semi-cylindrical metallic segments secured to the exterior of said semi-cylindrical elastomer segments.

12. A method for preventing abrasive wear between the exterior of a rotating drill string and the interior of a casing within which the drill string is rotated, comprising the steps of:

encircling the exterior of a drill pipe with an inner hub member formed of semi-cylindrical elastomer segments, each having a metallic semi-cylindrical cage element embedded therein and a semi-cylindrical low friction bearing surface on the exterior thereof;

drawing said inner hub member semi-cylindrical elastomer segments radially inward to firmly engage the exterior surface of said drill pipe and securing them in the engaged condition to rotate with said drill pipe;

mounting an outer buffer ring member on said inner hub member to encircle said low friction bearing surface and to rotate relative thereto, said outer buffer ring member formed of semi-cylindrical elastomer segments each having a metallic semi-cylindrical cage element embedded therein and having an exterior surface extending radially outward from said drill pipe to prevent contact between the exterior of said drill pipe and the interior of the casing within which the drill string is rotated; and said drill string and said inner hub member rotating together relative to said outer buffer ring member when it is frictionally engaged with the interior of said casing.

13. The method according to claim 12 in which said inner hub member cage elements are hingedly connected along adjacent longitudinal edges and have a plurality of mating circumferential protrusions along adjacent diametrically opposed longitudinal edges interfitting in vertically overlapped relation with apertures extending vertically through said protrusions; and said step of drawing said inner hub member semi-cylindrical elastomer segments radially inward and securing them in the engaged condition comprises pressing a tapered wedge pin vertically into said apertures to draw said protrusions together and said inner hub member semi-cylindrical segments radially inward to firmly grip the exterior of said drill pipe.

14. The method according to claim 12 in which said step of mounting said outer buffer ring member includes securing said outer buffer ring member semi-cylindrical segments together to form a unitary cylindrical body having a predetermined fixed interior diameter radially spaced from said inner hub member low friction bearing surface to define an annulus therebetween for passage of drilling fluid therethrough to lubricate said bearing surface and said radially spaced interior diameter of said buffer ring.

15. The method according to claim 14 in which said outer buffer ring member cage elements are hingedly connected along adjacent longitudinal edges and have a retaining pin receiving structure along their diametrically opposed longitudinal edges, and said step of mounting said outer buffer ring member includes installing a retaining pin in said retaining pin receiving structure to interconnect said outer buffer ring member semi-cylindrical segments together and form said unitary cylindrical body having a predetermined fixed interior diameter and predetermined fixed outer diameter.

* * * * *